United States Patent [19]

McSweeney

[11] Patent Number: 4,823,706

[45] Date of Patent: Apr. 25, 1989

[54] RAILWAY WAGON SUSPENSION SYSTEM

[75] Inventor: Brett S. McSweeney, Granville, Australia

[73] Assignee: The Ani Corporation Limited, New South Wales, Australia

[21] Appl. No.: 118,864

[22] Filed: Nov. 9, 1987

[30] Foreign Application Priority Data

Nov. 10, 1986 [AU] Australia ..... PH8878

[51] Int. Cl.[4] ..... B61F 5/38

[52] U.S. Cl. ..... 105/165

[58] Field of Search ..... 105/157.1, 159, 161, 105/165, 167, 168, 171, 177, 176, 211, 199.1

[56] References Cited

U.S. PATENT DOCUMENTS 4,660,476 4/1987 Franz ..... 105/168

4,676,172 6/1987 Bullock ..... 105/168

FOREIGN PATENT DOCUMENTS 464379 4/1937 United Kingdom ..... 105/168

*Primary Examiner*—Johnny D. Cherry

*Assistant Examiner*—Frank Williams

*Attorney, Agent, or Firm*—Ladas & Parry

[57] ABSTRACT

A railway wagon suspension system which includes an axle assembly comprised of two wheelsets supporting springs for the wagon and interconnected by linkages at each of their ends via a respective bellcrank both of which bellcranks are pivoted to the wagon, confronting arms of the two bellcranks being pivotally interconnected by a link, and the linkages from each end of the two wheelsets being pivotally connected to the other arm of a respective one of the bellcranks with the linkages from one wheelset being closer to the end of that arm than the linkages from the other wheelset.

7 Claims, 2 Drawing Sheets

RAILWAY WAGON SUSPENSION SYSTEM

This invention relates to suspension systems for railway wagons.

It is conventional practice on a four-axle freight and bulk rolling stock wagons to use a pair of two-axle bogies for wagon suspension. These freight bogies use a central load bearing pivot to transmit load from the wagon body through to the bogie frame, and hence through the wheels to the rails. The bogie is free to rotate about the central pivot which is lined with a low friction material. Due to the fact that the full car load is transmitted through the bogie frame from the central bearing to the axial journals it is necessarily a high mass structure, while as the load is conveyed from the wagon body through the side sill structures to the central pivot there is a substantial car bolster.

Another disadvantage of current bogie structures is that due to rigid parallel alignment between the wheelsets of the bogie being maintained during curving, and friction in the center pivot inhibiting bogie rotation, high wheel flange wear frequently occurs. Some previous efforts have been made to improve curving performance of freight wagons but these efforts have entailed structural additions to existing bogie frames which has exacerbated the high mass problem. As a consequence these efforts have hitherto failed to obtain acceptance on freight railways, especially with heavy haul operations where mass and maintenance are both critical factors.

It is the principal object of this invention to provide a railway wagon suspension system which substantially ameliorates the problems hitherto encountered.

To this end, in accordance with the invention there is provided a suspension system for a railway wagon having at least two axle assemblies one of which is disposed forwardly of the center of the length of the wagon body and the other is disposed rearwardly thereof, each of said axle assemblies comprising a pair of wheelsets spaced longitudinally with respect to the wagon body so that one of said wheelsets is outboard and the other of said wheelsets is inboard with respect to said center of said body; each of said wheelsets including an axle, a pair of wheels and axle boxes on the end portions of the axles; spring means supporting the wagon body upon said axle boxes; a pair of bellcranks having pivot mounts with respect to the wagon body and located adjacent opposite sides thereof; a first link extending transversely of said wagon body and pivotally interconnecting a first one of the arms of both of said bellcranks; and further links substantially longitudinally extending with respect to said wagon body and pivotally interconnecting a second one of the arms of each of said bellcranks to respective end portions of the pair of axles with pivoting fulcrums for said further links connected to the axle of the inboard wheelset being spaced closer to respective ones of said pivot mounts than the pivoting fulcrums of said further links connected to the axle of the outboard wheelset; whereby the outboard wheelset is permitted to pivot about a vertical axis to a greater extent than is the inboard wheelset, as the wagon negotiates a curve on a railway track.

The invention will be described in more detail with reference to the accompanying drawings, in which.

Figure 1:
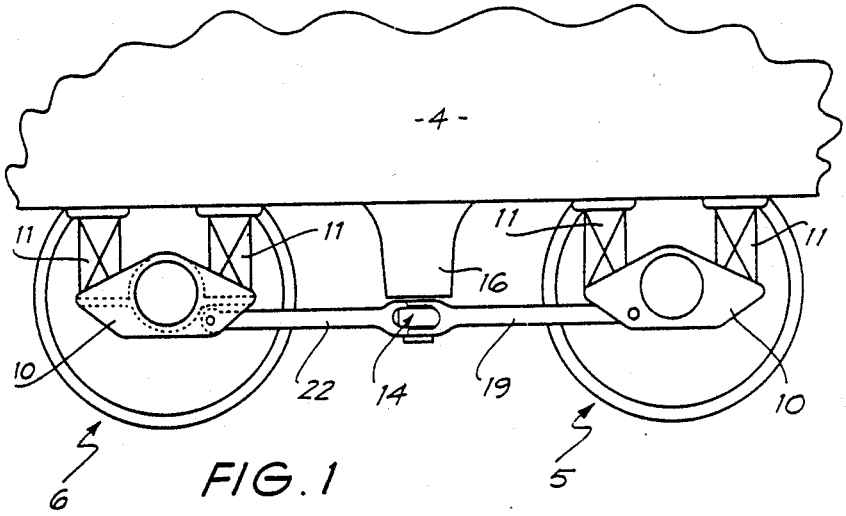
FIG. 1 shows in side elevation an axle assembly for a railway wagon according to the principles of the present invention.
Figure 2:
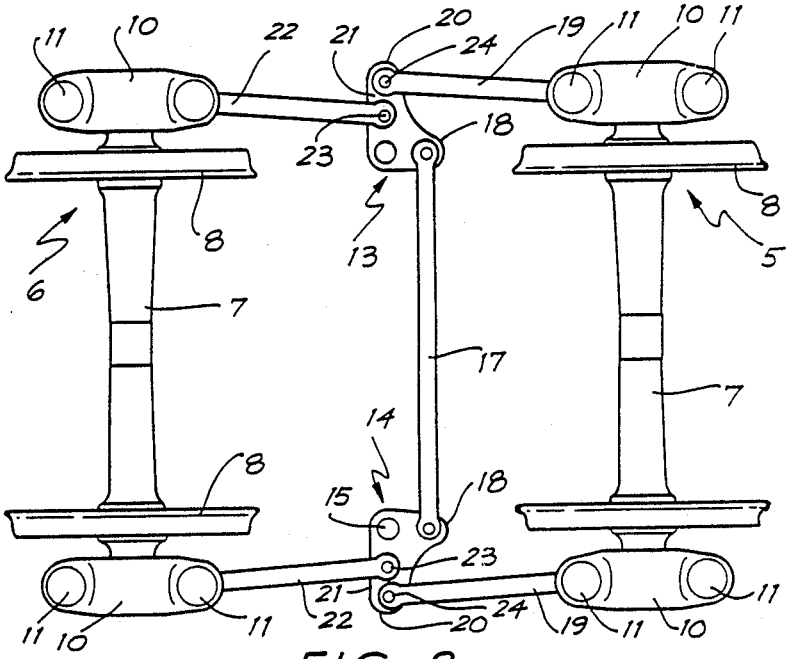
FIG. 2 is a plan view of the axle assembly.

The suspension system of the invention consists of at least a first axle assembly secured beneath a railway wagon body forwardly of its center and a second axle assembly secured beneath the body rearwardly of the center. One or more similar intermediate axle assemblies may also be incorporated for support of the wagon body. One such axle assembly is shown in FIGS. 1 and 2 which is assumed to be installed beneath the forward end of the wagon 4. The assembly consists of two wheelsets 5 and 6, each composed of an axle 7 and a pair of flanged wheels 8. As depicted in FIGS. 1 and 2 wheelset 5 is outboard and wheelset 6 is inboard with respect to the center line 9, i.e. the center of the length of the wagon body (see FIG. 3). Wherever used herein the expressions "outboard" and "inboard" refer to the relative positioning of wheelsets 5 and 6 on the longitudinal axis of the wagon body 4 and respective to the center line 9.

An axlebox 10 is carried upon each end of each of the axles 7 and the wagon body 4 is supported from each one of the axleboxes 10 by a pair of suitable springs 11. Thus independent suspension from each wheelset 5 and 6 is provided. A conventional form of spring 11 is known as a FLEXICOIL® type spring which will provide for limited transverse and longitudinal displacement of each wheelset 5 by from 25 mm to 200 mm depending upon the grade of spring.

Figure 3:
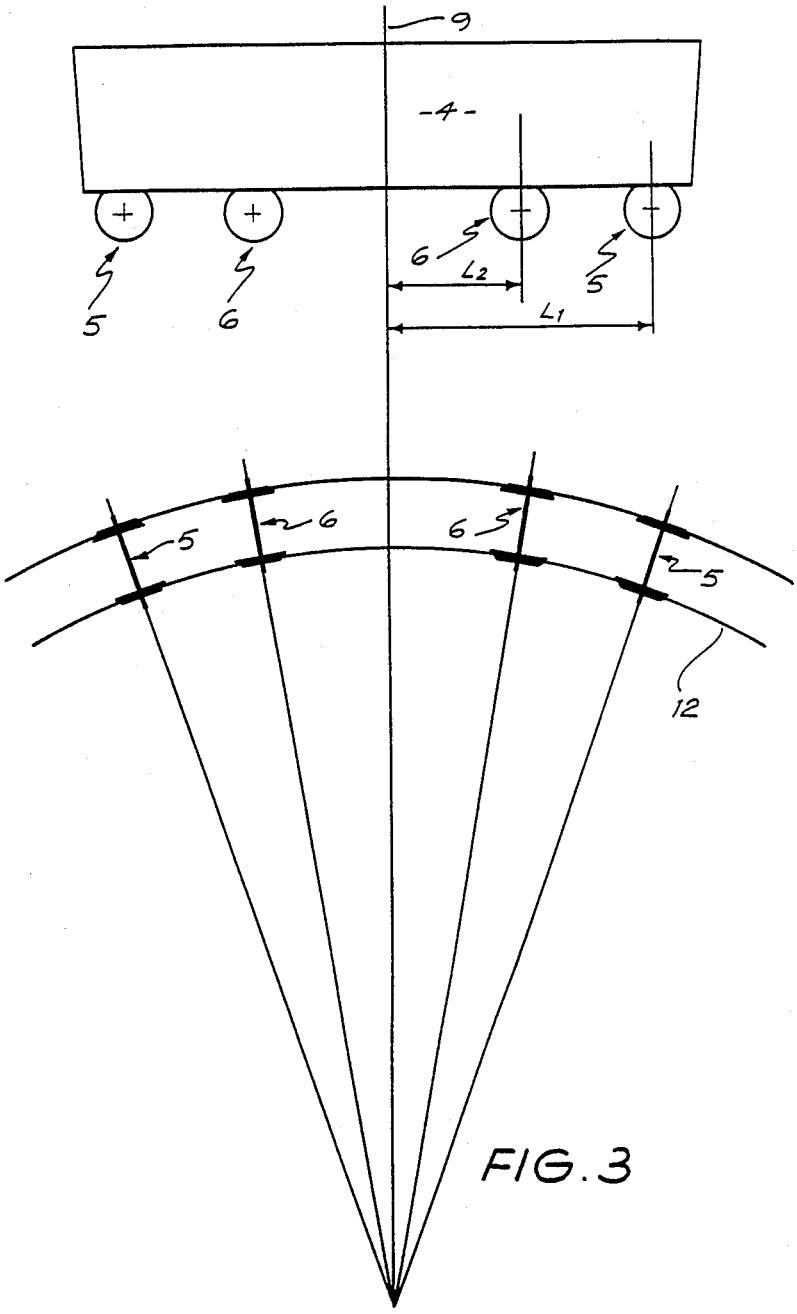
FIG. 3 is a diagrammatic representation of axle assemblies of this invention as rotated with respect to a wagon while negotiating a curve in a railway track.

It will be observed by reference to FIG. 3 that in the case of a wagon 4 provided with a pair of axle assemblies according to the invention, when negotiating a curve in the rails 12 the outboard wheelsets 5 pivot about a vertical axis to a greater extent than do the inboard wheelsets 6. It will be appreciated that the curve depicted and both the longitudinal and transverse displacement of the wheelsets 5 and 6 shown by FIG. 3 are exaggerated for illustrative purposes. In conventionl axle assemblies where the wheelsets 5 and 6 are maintained parallel, extensive wheel flange wear occurs especially with freight bogies. It is a feature of the present invention that the pivotting ratio between the outboard wheelset 5 and the inboard wheelset 6 is greater than unity. According to the principles of the invention this is achieved by the provision of a pair of bellcranks 13 and 14 supported upon fulcrums 15 secured to the underside of the wagon body 4 by individual fixed brackets 16 transversely spaced with respect to and adjacent the body 4 opposite sides thereof. A crosslink 17 pivotally interconnects corresponding arms 18 of each bellcrank 13 and 14 ensuring that they always pivot in the same direction and by corresponding amounts. Longitudinally extending links 19 pivotally interconnect respective ones of the axleboxes 10 associated with the outboard wheelset 5 to an end portion 20 of the other arm 21 of adjacent ones of the bellcranks 13 and 14. Further longitudinally extending links 22 pivotally interconnect respective ones of the wheelboxes 10 associated with the inboard wheelset 7 to the arms 21 of adjacent ones of the bellcranks 13 and 14. By this invention the attachment fulcrums 23 for the link 22 are positioned closer to the fixed beelcrank fulcrums 15 than the connecting fulcrums 24 of the links 19. The bellcranks 13 and 14 are installed upon the wagon body 4 so that when the axles 7 of the wheelsets 5 and 6 are in parallel their corresponding arms 18 are longitudinally aligned with the wagon body 4 and the arms 21 thereof are outwardly directed and and transversely aligned with the wagon body 4.

As a consequence of this construction and arrangement of the fulcrums 15, 23 and 24, each wheelset 5 and 6 is permitted to pivot about is mid point and with respect to the wagon body 4, while pivoting of the outboard wheelset 5 will always be to a greater degree than pivoting of the inboard wheelset 6, i.e. is in a ratio of $<1$. Hence, a more natural steering tendency of the wheelsets 5 and 6 of each axle assembly will result to reduce wheel flange wear. Furthermore, the overall construction of each axle assembly enables the use of relatively light-weight materials.

It will be appreciated that the degree of pivoting of the wheelsets 5 and 6 conforms to a fixed ratio determined by the relative spacings of the fulcrums 23 and 24 to their fixed fulcrum 15 on each of the bellcranks 13 and 14. Preferably this ratio is designed to be the same as, or close to, the ratio of distances L1 and L2 (FIG. 3), L1 being the distance from the center of the length of the wagon 4 to the axis of the wheel set 5 with L2 being the distance from that center to the axis of the wheel set 6. It is possible to obtain perfectly aligned positioning of the wheelsets 5 and 6 in any track curve, i.e. regardless of the radius. Preferably, also, all fulcrums such as 15, 23 and 24 will be made from spherical rubber joints, commonly referred to as spherilastics, in order to provide for angular movement, to absorb shock and to eliminate the need for greasing or regular maintenance.

Whereas a preferred embodiment has been described in the foregoing passages it should be understood that other forms, modifications and refinements are feasible within the scope of this invention.

I claim:

1. A suspension system for a railway wagon having at least two axle assemblies one of which is disposed forwardly of a center of a length of the wagon body and the other is disposed rearwardly thereof, each of said axle assemblies comprising a pair of wheelsets spaced longitudinally with respect to the wagon body so that one of said wheelsets is outboard and the other of said wheelsets is inboard with respect to said center of said body; each of said wheelsets including an axle, a pair of wheels and axle boxes on end portions of the axles; spring means supporting the wagon body upon said axle boxes; a pair of bellcranks having pivot mounts with respect to the wagon body and located adjacent to opposite sides thereof; a first link extending transversely of said wagon body and pivotally interconnecting a first set of arms of said bellcranks; and further links substantially longitudinally extending with respect to said wagon body and pivotally interconnecting pivoting fulcrums of a second set of arms of said bellcranks to respective axle boxes, said pivoting fulcrums for said further links connected to the axle boxes of the inboard wheelset being spaced closer to said pivot mounts than the pivoting fulcrums of said further links connected to the axle boxes of the outboard wheelset so that the outboard wheelset is permitted to pivot about a vertical axis to a greater extent than is the inboard wheelset as the wagon negotiates a curve on a railway track.

2. A suspension system according to claim 1, wherein said spring means comprises a pair of springs supporting the wagon body from each one of said axle boxes.

3. A suspension system according to claim 2, wherein each of said springs is a FLEXICOIL® type spring permitting limited transverse and longitudinal displacement between each of said wheelsets and the wagon body.

4. A suspension system according to claim 1, wherein said pivot mounts for respective ones of said pair of bellcranks are fixed brackets transversely spaced on the underside of the wagon body and adjacent opposite sides thereof.

5. A suspension system according to claim 1, wherein the ratio between said spacing to said pivot mount of either one of said bellcranks of said pivoting fulcrums of said further links connected to said outboard wheelset and to said inboard wheelset corresponds to the ratio of the spacing from the center of the length of the wagon body to the axis of said outboard and inboard wheelsets.

6. A suspension system according to claim 5, wherein said ratios are the same.

7. A suspension system according to claim 1, wherein with parallel alignment of said axles of said outboard and inboard wheelsets said bellcranks are disposed whereby said first set of arms of said bellcranks are longitudinally aligned with said wagon body and said second set of arms of said bellcranks are outwardly directed and transversely aligned with said wagon body.

* * * * *